US010272276B2

(12) United States Patent
Yeum et al.

(10) Patent No.: US 10,272,276 B2
(45) Date of Patent: Apr. 30, 2019

(54) COOLING DEVICE FOR SPONTANEOUS COMBUSTION PREVENTION

(71) Applicant: PEOPLE I CO., LTD., Daejeon (KR)

(72) Inventors: Chan Sub Yeum, Cheongju-si (KR); Ju Young Lim, Daejeon (KR); Hyun Wook Moon, Daejeon (KR)

(73) Assignee: PEOPLE I CO., LTD., Daejeon (KR)

( * ) Notice: Subject to any disclaimer, the term of this patent is extended or adjusted under 35 U.S.C. 154(b) by 17 days.

(21) Appl. No.: 15/366,262

(22) Filed: Dec. 1, 2016

(65) Prior Publication Data

US 2018/0021610 A1 Jan. 25, 2018

(30) Foreign Application Priority Data

Jul. 22, 2016 (KR) ..... 10-2016-0093563

(51) Int. Cl.

| | |
|---|---|
| ***A62C 3/04*** | (2006.01) |
| ***C10L 5/04*** | (2006.01) |
| ***F23K 3/00*** | (2006.01) |
| ***A62C 3/06*** | (2006.01) |
| ***A62C 99/00*** | (2010.01) |

(52) U.S. Cl.

CPC ..... *A62C 3/04* (2013.01); *A62C 3/06* (2013.01); *A62C 99/0018* (2013.01); *C10L 5/04* (2013.01); *F23K 3/00* (2013.01); *C10L 2290/06* (2013.01); *F17C 2221/014* (2013.01); *F17C 2260/042* (2013.01)

(58) Field of Classification Search

CPC combination set(s) only.

See application file for complete search history.

(56) References Cited

U.S. PATENT DOCUMENTS

2015/0376531 A1* 12/2015 Atarashiya ..... C10L 9/06 44/629
2018/0135896 A1* 5/2018 Petersen ..... F25B 9/008

FOREIGN PATENT DOCUMENTS

CN 204246717 U 4/2015
KR 10-0509232 B1 8/2005

(Continued)

OTHER PUBLICATIONS

Chul Jin Kim, et al., "Numerical Study on the Phenomenon of Spontaneous Ignition of Coal Stockpile", Transactions of the Korean Society of Mechanical Engineers B, 2010, pp. 721-272, vol. 34, Issue 7.

(Continued)

*Primary Examiner* — Ellen M McAvoy
*Assistant Examiner* — Chantel L Graham
(74) *Attorney, Agent, or Firm* — Paratus Law Group, PLLC

(57) ABSTRACT

The present invention relates to a cooling device for preventing fire due to spontaneous combustion of coal stockpiles in a coal-fired power plant, and more specifically, to a cooling device for preventing spontaneous combustion of coal stockpiles, for which a plurality of cooling devices are provided at a predetermined interval in coal stockpiles and, when a temperature (ignition temperature) specified by a user is detected from the outer surface, compressed liquefied nitrogen stored in the cooling device is ejected to lower a temperature around the loaded coal, thereby preventing spontaneous combustion by the oxidation of coal.

13 Claims, 12 Drawing Sheets

(56) References Cited

FOREIGN PATENT DOCUMENTS

| | | | |
|---|---|---|---|
| KR | 10-2006-0002677 | A | 1/2006 |
| KR | 20-0445106 | Y1 | 6/2009 |
| KR | 10-2010-0017130 | A | 2/2010 |
| KR | 10-0953937 | B1 | 4/2010 |
| KR | 10-2010-0074549 | A | 7/2010 |
| KR | 10-2012-0139227 | A | 12/2012 |
| WO | WO2014136479 | * | 9/2014 |

OTHER PUBLICATIONS

Korean Office Action for related KR application No. 10-2016-0093563 dated Mar. 26, 2018 from Korean Patent Office.

* cited by examiner

COOLING DEVICE FOR SPONTANEOUS COMBUSTION PREVENTION

CROSS REFERENCE TO PRIOR APPLICATION

This application claims priority to Korean Patent Application No. 10-2016-0093563 (filed on Jul. 22, 2016), which is hereby incorporated by reference in its entirety.

BACKGROUND

1. Field

The present invention relates to a cooling device for preventing fire due to spontaneous combustion of coal stockpiles in a coal-fired thermal power plant, and more specifically, to a cooling device for preventing spontaneous combustion of coal stockpiles, for which a plurality of cooling devices are provided at a predetermined interval in coal stockpiles and, when a temperature (ignition temperature) specified by a user is detected from an outer surface, compressed liquefied nitrogen stored in the cooling device is ejected to lower a temperature around the loaded coal, thereby preventing spontaneous combustion by the oxidation of coal.

2. Description of Related Art

Generally, a coal-fired thermal power plant burns approximately 180 tons of coal per hour to produce 500 MW of electric energy, and approximately 37 tons of coal is supplied to a boiler per pulverizer. The coal-fired thermal power plant with a capacity of 500 MW has six coal yards, each with a storage capacity of approximately 500 tons, the normal supply of coal is performed in five of them and the remaining one is operated as a stockyard to store coal reserves which can be used for a certain period of time.

Because coal is a combustible material, when coal is stored in an enclosed area or indoor, constituent molecules of the coal absorb the oxygen in the air, causing an exothermic oxidation reaction in a local part (hot spot), and if the heat generated at this time is not sufficiently released to the outside and the oxygen is continuously supplied while the temperature rises, the reaction may be accelerated and combustion may occur.

When coal is loaded in an outdoor storage place, problems may arise in that the powder dust is blown and pollutes the environment of the workplace and some of raw materials are lost due to the wind. Thus, nowadays coal is stacked in piles and stored in a closed storage room, so the risk of spontaneous combustion is increased.

Causes and effect factors of spontaneous combustion are very complex and hence it is not easy to prevent in advance. Also, once spontaneous combustion occurs, it is difficult to extinguish, and since coal is a prosperous substance, the amount of oxygen absorbed per unit weight is large, which is advantages for oxidation reaction, but the thermal conductivity of the coal is low, and thus the generated heat is difficult to release.

In addition, gas produced during the spontaneous combustion process may cause gas explosion if not released to the outside, and the spontaneous ignition in a storage facility may lead to dust explosion. As such, safety management for prevention of spontaneous combustion is very important in the area where the coal is stored, so measures against fire occurrences are needed.

To address the aforementioned problems, various methods for suppressing ignition of coal have been suggested, but still there is a need for a device and/or method that is effective, while requiring low-cost facility construction and low operational cost.

RELATED ART DOCUMENTS

Patent Document (Patent Document 1) KR10-2012-0139227 A
(Patent Document 2) KR10-2010-0074549 A
(Patent Document 3) KR10-2006-0002677 A

Non-Patent Document

1. "A Numerical Study on Phenomenon of Spontaneous Ignition of Coal Stockpile", Transactions of the Korean Society of Mechanical Engineers B, Volume 34, Issue 7

SUMMARY

One objective of the present invention is to provide a technology through which low-cost installation is realized without additional expansion of facilities and equipment, a coolant that is harmless to the human body is used to prevent spontaneous combustion and contribute to fire extinguishment, and spontaneous combustion is predicted on the basis of distribution of heat points collected from coal stockpiles.

Another objective of the present invention is to address a problem of deformation due to high temperature and high pressure by constructing a dual-structure tank in which environment-friendly liquefied nitrogen is provided, and to prevent malfunction due to external impact.

In one general aspect, there is provided a cooling device for preventing spontaneous combustion of coal stockpiles, the cooling device including: an outer case (100) having an accommodation space (S) formed therein and having discharge holes (102) and (102*a*) through which a coolant disposed in the storage space (S1) is disposed to an outside; injection valves (400) and (410) which opens and closes the discharge holes (102) and (102*a*); and a control module (500) configured to measure an external temperature and control opening and closing of the injection valves (400) and (410) based on at least the external temperature.

The cooling device may further include: an inner case (200) disposed in the accommodation space (S) and having a storage space (S1) in which the coolant is stored; and supply valves (300) and (310) configured to selectively supply the coolant stored in the storage space (S1) to the accommodation space (S).

The control module (500) may control opening and closing of the supply valves (300) and (310) based on at least the external temperature.

A pressure in the storage space (S1) in which the coolant is stored may be higher than a pressure in the accommodation space (S).

The inner case (200) may further include a bottom plate (210) which is slid in a moving direction of the coolant along an inner surface of the storage space (S1) when the coolant in the storage space (S1) is moved to the accommodation space (S).

The outer case (100) may include an upper case (110) having a lower side opened, a lower case (120) coupled to the upper case (100) to form the accommodation space (S), and a fixing arm (130) protrudes from an inner surface of the upper case (110) or the lower case (120) and has one end coupled to an outer surface of the inner case (200) to attach and detach the inner case (200).

The discharge hole (102) may include a first hole (102-1) adjacent to an outer surface of the outer case (100) and a second hole (102-2) extending from the first hole (102-1) and adjacent to an inner surface of the outer case (100)

A diameter of the second hole (102-2) may be greater than a diameter of the first hole (102-1).

The outer case (100) may includes an upper case (110) in a hollow hemispherical shape which has an opening (113) formed in a circular shape on an upper side and is opened downward; a lower case (120) in a hollow hemispherical shape which is opened upward to form the accommodation space (S) and is coupled to the upper case (110); and an electrical unit case (115) which covers the opening (113) of the upper case (110) and partitions a part of the accommodation space (S) to form an installation space (S2).

The control module (500) may be disposed in the installation space (S2) so as to be shielded from the accommodation space (S).

The cooling device may further comprise a battery unit (700) disposed in the installation space (S2).

The inner case (200) may include a coolant discharge hole (313) opened to a side where the battery unit (700) is disposed.

The supply valve (310) may be disposed to vertically pass through the battery unit (700) and open and close the coolant discharge hole (313) while linearly moving so as to mutually seal the accommodation space (S) and the installation space (S2).

The battery unit (700) may include a shielding flange (711) at a lower end thereof which is hermitically coupled to a lower end of the electrical unit case (115); and a battery case (720) which has a valve installation hole (713) at the center thereof for installing the supply valve (310) and is coupled to the shielding flange (711).

The discharge hole (102*a*) may be disposed to extend in a straight line along the upper case (110) and the lower case (120), and the injection valve (400*a*) may rotate between the upper case (110) and the lower case (120) to open and close the discharge hole (102*a*).

The injection valve (400*a*) may include a valve rotary plate (410) which is rotatably disposed along a parting line (P) that separates an inner surface of the upper case (100) from an inner surface of the lower case (120) and which is disposed to overlap with the discharge hole (102*a*).

The valve rotary plate (410) may include a communication hole (411) which simultaneously communicates with the discharge hole (102*a*) and the accommodation space (S).

The cooling device may further comprise a guide pipe (600) extending outward from an outer surface of the outer case and configured to guide a moving path of the coolant discharged from the discharge hole (102).

The guide pipe (600) may have a plurality of ejection holes (610) on a sidewall thereof to eject the coolant.

In another general aspect, there is provided a cooling device for preventing spontaneous combustion of coal stockpiles, the cooling device including: an outer case (100) having an accommodation space (S) formed therein and having an opening (101) communicating with the accommodation space (S) and a plurality of discharge holes (102) having a predetermined diameter formed on one side thereof; an inner case (200) located in the accommodation space (S) and having a storage space (S1) formed therein in which a liquid coolant is compressed and accommodated at a constant pressure; a supply valve (300) configured to open and close one side of the inner case (200) to discharge the coolant accommodated in the storage space (S1) to the accommodation space (S) when a temperature reaches a predetermined temperature; a backflow prevention valve (400) installed in the discharge hole (102) and configured to open and close the discharge hole (102) to eject the coolant to an outside of the outer case (100) when the coolant is located in the accommodation space (S); and a control module (500) including: a temperature sensor (510) having a portion exposed to the outside of the outer case (100) to measure an external temperature of the outer case (100); and an opening/closing controller (520) configured to control opening and closing of the supply valve (300) and the backflow prevention valve (400) according to a temperature value measured by the temperature sensor (510).

In still another general aspect, there is provided a system for collecting a cooling device for preventing spontaneous combustion of coal stockpiles, the system comprising: a moving belt (1100) configured to carry a mixture of the cooling device and coal thereon to move the mixture; and a collecting module (2000) positioned above the moving belt (1100) and configured to sort the coal and the cooling device and collect the cooling device, wherein the collecting module (2000) includes: a sorter (2100) having one end inserted into the coal to sort the cooling device from the coal, a traction roller (2200) configured to transfer the cooling device sorted in the sorter (2100) from one side of the sorter (2100) to the other side, and a transport roller (2300) configured to receive the cooling device transferred by the traction roller (2000) and transfer the cooling device to a predetermined area.

Other features and aspects will be apparent from the following detailed description, the drawings, and the claims.

Figure 1:
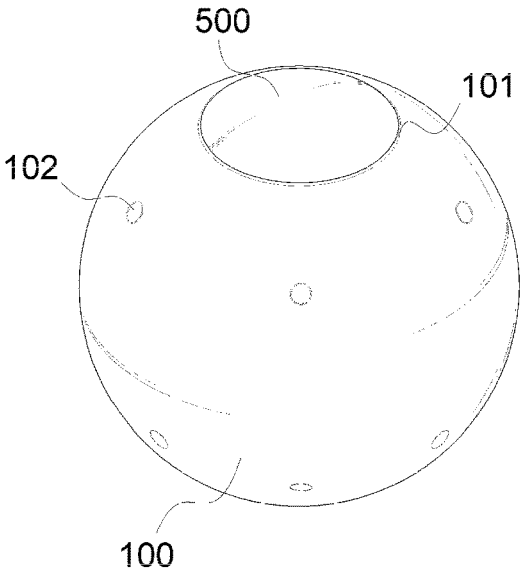
FIG. 1 is a perspective view showing the overall shape of a cooling device for preventing spontaneous combustion of coal stockpiles of the present invention.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The present invention now will be described more fully hereinafter with reference to the accompanying figures, in which embodiments of the invention are shown.

It will be understood that, although the terms first, second, etc. may be used herein to describe various elements, these elements should not be limited by these terms. These terms are only used to distinguish one element from another. For example, a first portion could be termed a second portion, and, similarly, a second portion could be termed a first portion without departing from the teachings of the disclosure.

When an element is referred to as being "on," "connected" or "coupled" to another element, then the element can be directly on, connected or coupled to the other element and/or intervening elements may be present, including indirect and/or direct variants. In contrast, when an element is referred to as being "directly connected" or "directly coupled" to another element, there are no intervening elements present. In addition, it is understood that when a first element is connected to or accesses a second element in a network, the first element and the second element can transmit and receive data therebetween.

In the following description, usage of suffixes such as 'module' or 'unit' used for referring to elements is given merely to facilitate explanation of the present invention, without having any significant meaning by itself. Thus, the 'module' and 'unit' may be used together.

When the elements described herein are implemented in the actual applications, two or more elements may be combined into a single element, or one element may be subdivided into two or more elements, as needed. Herein, the same drawing reference numerals are understood to refer to the same elements, and a detailed description of known functions and configurations incorporated herein will be omitted when it may obscure the subject matter with unnecessary detail.

Figure 2:
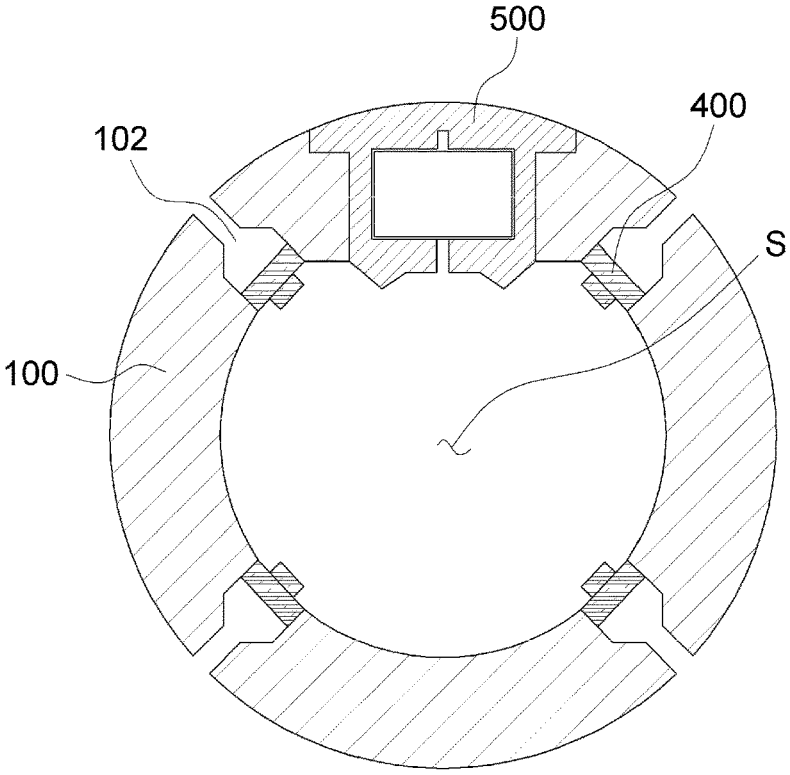
FIG. 2 is a cross-sectional view showing an internal structure according to one embodiment of the present invention.
Figure 3:
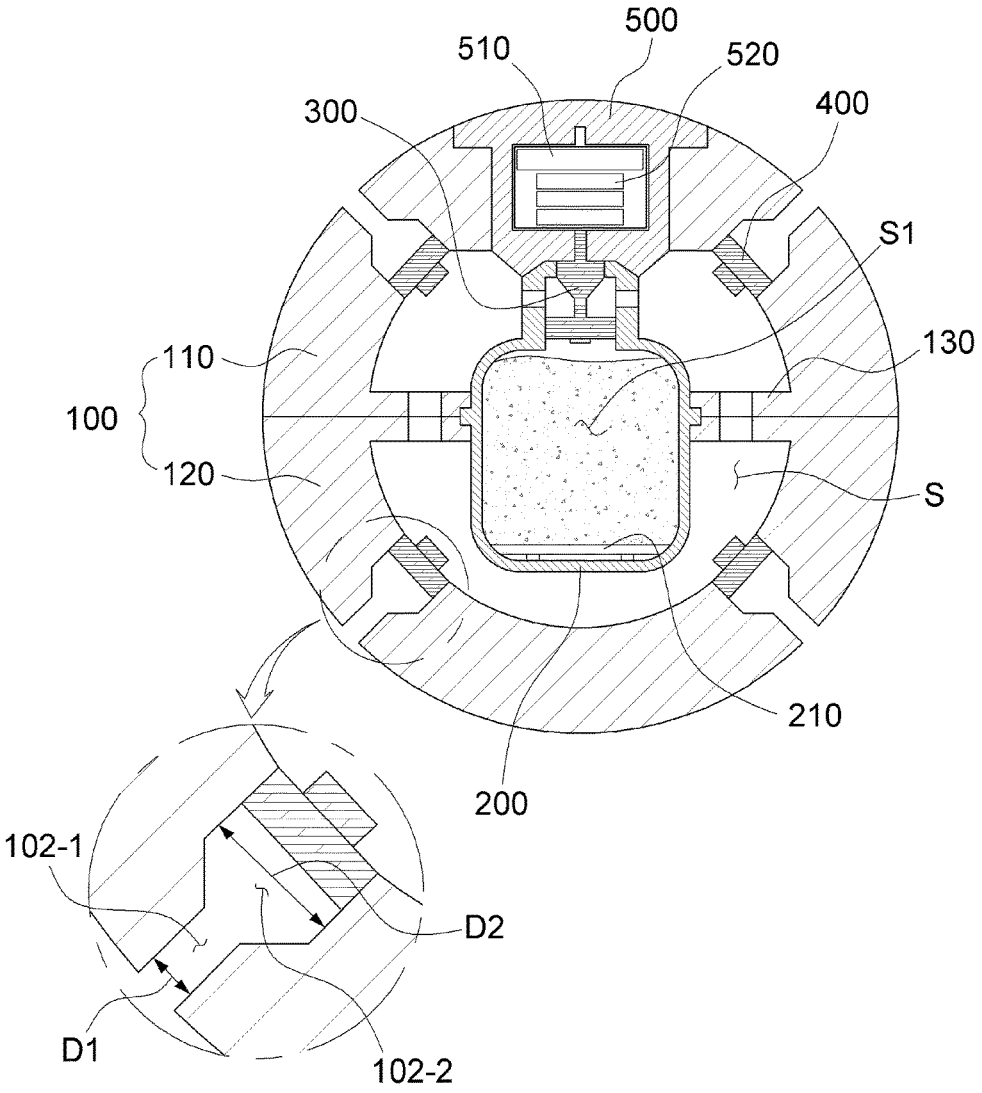
FIG. 3 is a cross-sectional view showing an internal structure according to another embodiment of the present invention.
Figure 4:
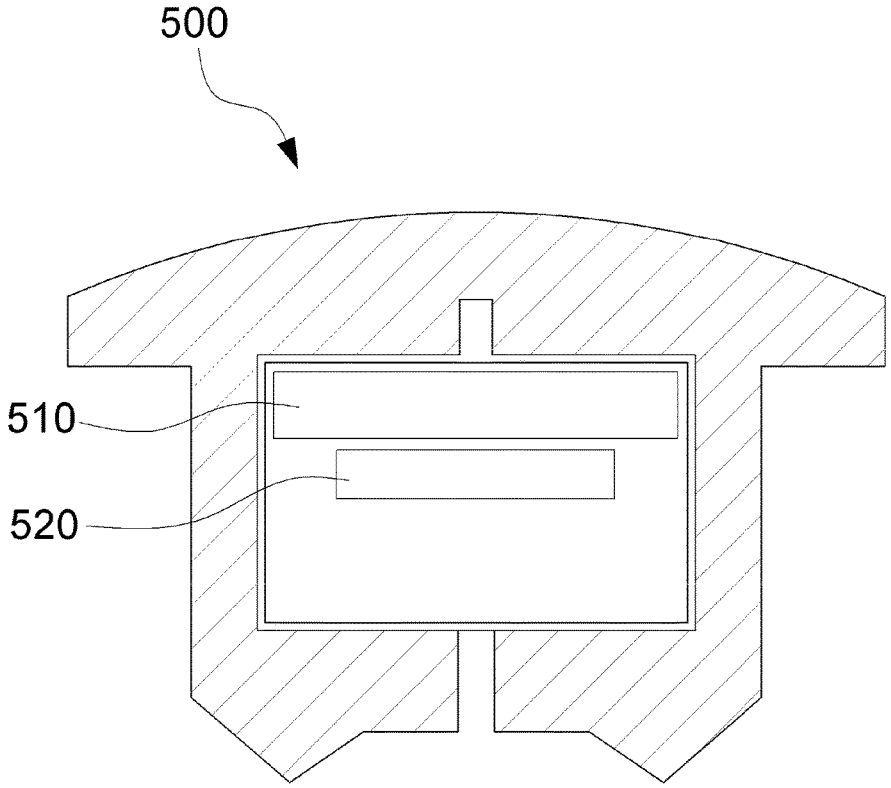
FIG. 4 is a cross-sectional view showing a main structure of a control module according to one embodiment of the present invention.
Figure 5:
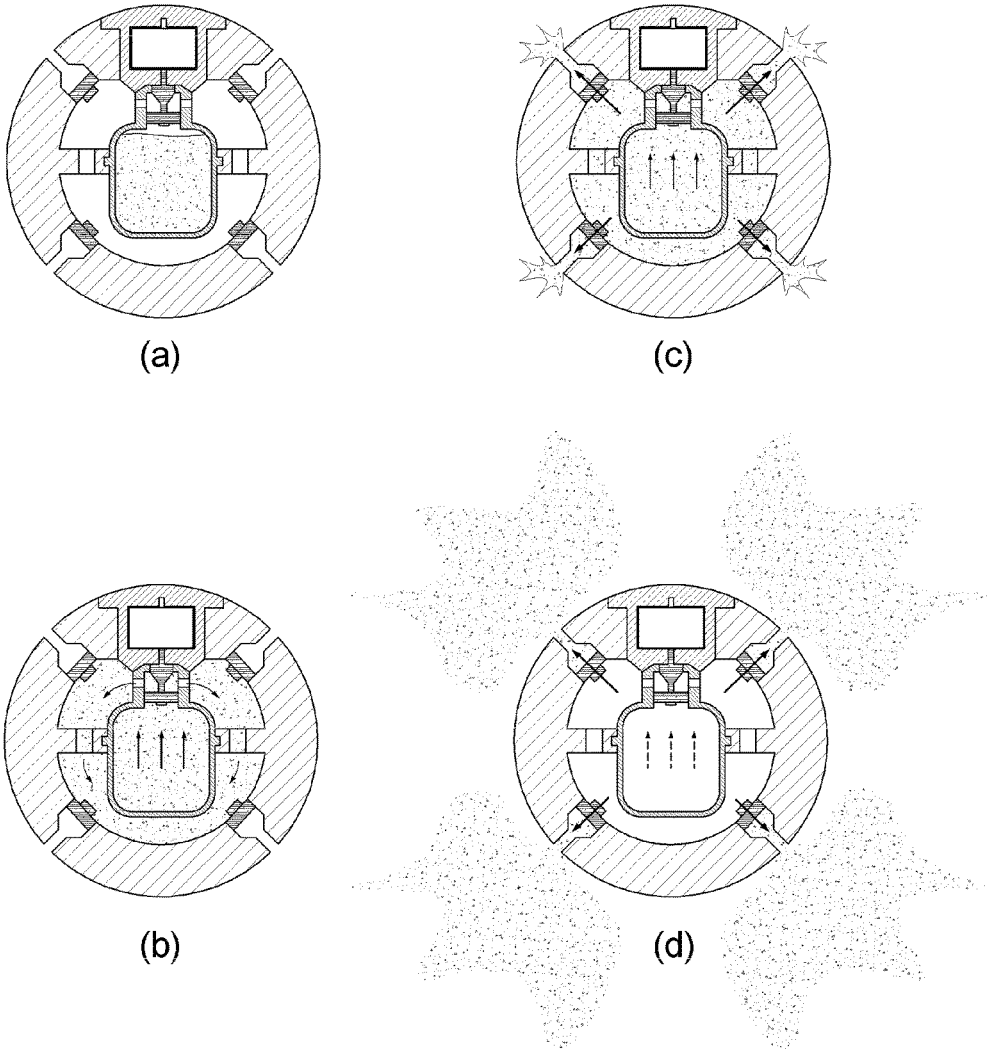
FIG. 5 illustrates cross-sectional views showing operational states of the cooling device.
Figure 6:
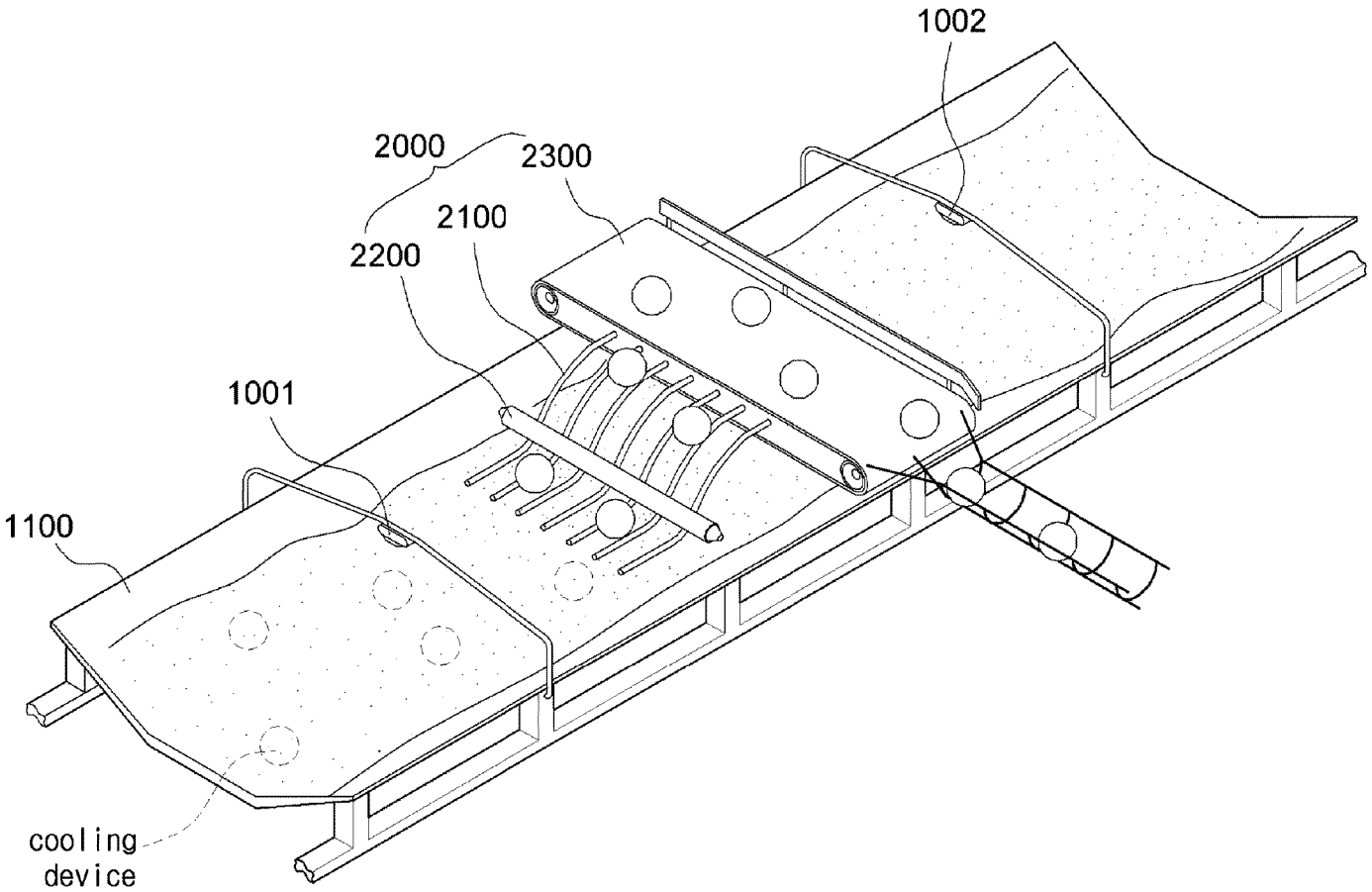
FIG. 6 is a perspective view showing a collection method according to one embodiment of the present invention.

FIG. 1 is a perspective view showing the overall shape of a cooling device for preventing spontaneous combustion of coal stockpiles of the present invention, FIG. 2 is a cross-sectional view showing an internal structure according to a first embodiment of the present invention, FIG. 3 is a cross-sectional view showing an internal structure according to a second embodiment of the present invention, FIG. 4 is a cross-sectional view showing a main structure of a control module of the present invention, FIG. 5 illustrates cross-sectional views showing operational states of the cooling device, and FIG. 6 is a perspective view showing a collection method of the first embodiment and the second embodiment of the present invention.

Referring to FIGS. 1, 2, and 4, the cooling device for discharging a coolant to the outside in order to prevent spontaneous ignition of coal according to the first embodiment is located in a coal storage yard where coal stockpiles are stored and includes an outer case 100, injection valves 400, and a control module 500.

The outer case 100 may have an accommodation space S formed therein. The outer case 100 may have a predetermined thickness, and preferably have a cylindrical or spherical shape. The outer case 100 may be preferably formed of a metallic material.

An opening 101 communicating with the accommodation space S may be formed at one side of the outer case 100.

The outer case 100 may have a plurality of discharge holes 102 of a predetermined diameter formed on the outer surface thereof which communicate with the accommodation space S and are spaced apart from each other by a predetermined distance. The discharge holes 102 may discharge the coolant contained in the accommodation space S to the outside.

The coolant may be liquefied nitrogen, carbon dioxide, halon or the like which is harmless to the human body, and may be preferably in a liquid state in order to reduce the volume. The coolant may be preferably mainly liquefied nitrogen. In addition to the aforementioned types, any coolant may be used as long as it is capable of preventing the risk of ignition (fire) by lowering the ambient temperature.

The injection valves 400 may open and close the respective discharge holes 102. The injection valves 400 may selectively discharge the coolant contained in the accommodation space S to the outside. The injection valves 400 may prevent contaminants, such as coal dust and other dust, from flowing into the accommodation space S of the outer case 100.

When the pressure of the coolant contained in the accommodation space S is exerted on the injection valve 400, the injection valve 400 opens the discharge hole 102 to inject the coolant toward the outer side of the outer case 100.

The control module 500 may control the opening and closing of the injection valve 400. The control module 500 may be preferably disposed on the opening 101. The control module 500 may be formed, at least in part, of a non-metallic material, preferably a plastic material, for communication with the outside or for operation of temperature and/or pressure sensors, which will be described below.

The control module 500 may include a temperature sensor 510 and an opening/closing controller 520.

The temperature sensor 510 may include a contact type sensor for measuring the ambient temperature of the outer case 100 in contact with coal or the like and/or a non-contact temperature sensor for measuring heat radiated from the coal or the like.

The opening/closing controller 520 may control the opening and closing of the injection valve 400 on the basis of at least the external temperature.

Referring to FIG. 3, the cooling device according to the second embodiment includes an outer case 100, injection valves 400, a control module 500, an inner case 200, and a supply valve 300. The detailed descriptions of the same or similar components will be referred to FIGS. 1, 2, and 4.

The inner case 200 may be formed to be provided inside the outer case 100. The inner case 200 may be preferably hollow inside in order to store a liquid coolant therein.

Inside the inner case 200, a storage space S1 may be formed to accommodate the coolant. The coolant may be preferably compressed and stored in the inner case 200 at a constant pressure. This is to ensure that the coolant can be quickly discharged to the outside.

The partitioning of the cooling device into the storage space S1 and the accommodation space S may make it easier to recharge or replace the coolant, prevent accidents caused by the ejection of the coolant, maintain a constant temperature of the coolant, and/or prevent the coolant pressure from rising.

The supply valve 300 may open one side of the inner case 200 and discharge the coolant to the outside of the inner case 200. The supply valve 300 is provided on one side of the inner case 200 and may open the storage space S1 so that the coolant can flow into the accommodation space S.

The supply valve 300 may preferably operate in a specific environment set by a user. For example, when the ambient temperature of the outer case 100 is measured through the temperature sensor 510 for measuring the external temperature of the outer case 100 and then the temperature of the outer case 100 reaches a specific temperature set by the user, the supply valve 300 is opened to transfer the coolant to the accommodation space S. The coolant which has moved to the accommodation space S passes through the discharge hole 102 and is discharged to the outside of the outer case 100, so that the temperature around the outer case 100 can be lowered.

The opening/closing controller 520 may sequentially open the supply valve 300 and the injection valves 400 on the basis of the temperature measured through the temperature sensor 510, i.e., the external temperature.

The control module 500 may include a power supply (not shown) for supplying power to a temperature sensor 510, an opening/closing controller 520, a supply valve 300 and a backflow prevention valve 400, a pressure sensor (not shown) for measuring an external pressure and a storage unit for storing the temperature measured by the temperature sensor 510, and may further include a communicator for transmitting stored data to the outside.

In addition to the above-described function of preventing foreign materials from flowing into the accommodation space S, the injection valves 400 may maintain the pressure of the accommodation space S lower than the pressure of the storage space S1 for storing the coolant, so that the movement of the coolant from the storage space S1 to the accommodation space S can be accelerated.

Preferably, the injection valves 400 may block the introduction of external air into the accommodation space S through the discharge holes 102 so that the interior of the accommodation space S can be maintained in a vacuum state. When the accommodation space S is maintained in a vacuum state, the supply valve 300 is opened to speed up the discharge speed of the coolant when the coolant is discharged from the inner case 200 to the accommodation space S, thereby shortening the time.

The cooling device may further include a bottom plate 210 in the inner case 200 wherein the bottom plate 210 is slidable in a vertical direction along the inner wall surface of the inner case 200. When the bottom plate 210 is slid upward, the coolant may be discharged from the inner case 200 (i.e., the storage space S1) to the accommodation space S. The sliding of the bottom plate 210 in the upward direction may force the coolant to be discharged to the accommodation space S.

In addition, the sliding of the bottom plate 210 in the upward direction may allow the pressure maintained by the coolant when the coolant is received in the storage space S1 to be maintained substantially the same as the pressure maintained by the coolant when the coolant is moved to the accommodation space S. Thus, when the coolant is ejected to the outside, the coolant can be ejected at a high pressure to reach a wide range.

The outer case 100 may include an upper case 110 and a lower case 120. The upper case 110 may have a shape in which the lower side is opened. In addition, the lower case 120 is coupled to the upper case 110 and may have a shape in which the upper side is opened such that the accommodation space S is formed between the coupled upper case 110 and lower case 120.

A fixing arm 130 may protrude from the inner surface of the upper case 110 or the lower case 120. The fixing arm 130 may contact the outer surface of the inner case 200 to fix the inner case 200. This makes it possible to easily attach and detach the inner case 200 and facilitate the replacement of the inner case 200 after the coolant is ejected, or to help refill the coolant in the storage space S1 of the inner case 200.

The refill of the coolant in the storage space S1 may be performed using various methods, such as by separating the aforesaid upper case 110 from the lower case 120, by separating the control module 500 disposed on the opening 101 from the upper case 110, and the like.

The discharge hole 102 may include a first hole 102-1 adjacent to the outer surface of the outer case 100 and a second hole 102-2 adjacent to the inner surface of the outer case 100. The diameter D1 of the first hole 102-1 may be preferably smaller than the diameter D2 of the second hole 102-2. This makes it possible to eject the coolant at a higher pressure to expand the range in which the coolant is ejected when the coolant is ejected through the discharge hole 102.

The operation shown in FIG. 5 will be described with reference to the cooling device of FIG. 3.

FIG. 5(*a*) illustrates the cooling device of the present invention which is located in coal stockpiles. The control module 500 may measure the ambient temperature of the outer case 100 through the temperature sensor 510 in real time.

Referring to FIG. 5(*b*), when the risk of ignition arises according to an ignition risk model preset based on the ambient temperature of the outer case 100, the opening/closing controller 520 primarily opens the supply valve 300 so that the coolant is moved from the storage space S1 to the accommodation space S. At this time, when the pressure in the accommodation space S before the coolant flows into it is low, the movement of the coolant may be facilitated. In addition, the sliding of the bottom plate 210 may facilitate the movement of the coolant.

Referring to FIG. 5(*c*), the opening/closing controller 520 may open the injection valves 400 so that the coolant contained in the accommodation space S can be ejected to the outside of the outer case 100 through the discharge holes 102.

The opening/closing controller 520 may open the injection valves 400 after a predetermined time after opening the supply valve 300, or may open the injection valves 400 when there is a risk of ignition predetermined by the ignition risk model.

Referring to FIG. 5(*d*), the ejected coolant penetrates between the coals and lowers the ambient temperature, thereby preventing the risk of spontaneous combustion of the coal. Afterwards, the used inner case 200 is collected and recharged with the coolant, and then is mounted in the outer case 100 to be resupplied to the coal stockpiles.

A method of collecting the cooling device of the present invention will be described with reference to FIG. 6. The cooling device in accordance with FIG. 6 may be the cooling device according to various embodiments (the first embodiment and the second embodiment).

Coal and the cooling devices according to the present invention are both transferred to a moving belt 1100 in a coal storage yard. The coal and the cooling devices may be moved through the moving belt 1100 while they are maintained as a mixture on the moving belt 1100.

The line of the moving belt 1100 may be provided with a first detection sensor 1001 for detecting the presence or absence of the cooling device. When the first detection sensor 1001 recognizes the cooling device, a collecting module 2000 spaced apart from the first detection sensor by a predetermined distance may operate to collect the cooling device. In this case, a second detection sensor 1002 positioned symmetrically to the first detection sensor 1001 with respect to the collecting module 2000 is provided to detect the presence or absence of the cooling device which has not been yet collected.

The collecting module 2000 may include a sorter 2100, a traction roller 2200 and a transport roller 2300.

The sorter 2100 may have a shape inclined at a predetermined angle so that one end thereof is adjacent to the moving belt 1100 and the other end is located on the transport roller 2300. The sorter 2100 may have preferably a lattice-like mesh shape so that the coal can pass through the sorter 2100.

The cooling device which is filtered by the sorter 2100 may be moved to the transport roller 2300 through the traction roller 2200. The traction roller 2200 may contact the outer surface of the cooling device filtered by the sorter 2100. As the traction roller 2200 rotates in the same direction as the moving direction of the moving belt 1100, the cooling device may receive the rotational force of the traction roller 2200 and move to the transport roller 2300 along the inclined surface of the sorter 2100.

Then, the sorted cooling device may be moved to a specific area along the transport roller 2300 and resupplied to the coal stockpiles.

The cooling devices with the above-described configuration according to the present invention are disposed at a predetermined interval in the coal stockpiles, and when the measured temperature reaches a set temperature, accommodated liquefied nitrogen is ejected to the outside to lower the ambient temperature, thereby preventing spontaneous ignition of the coal.

Figure 7:
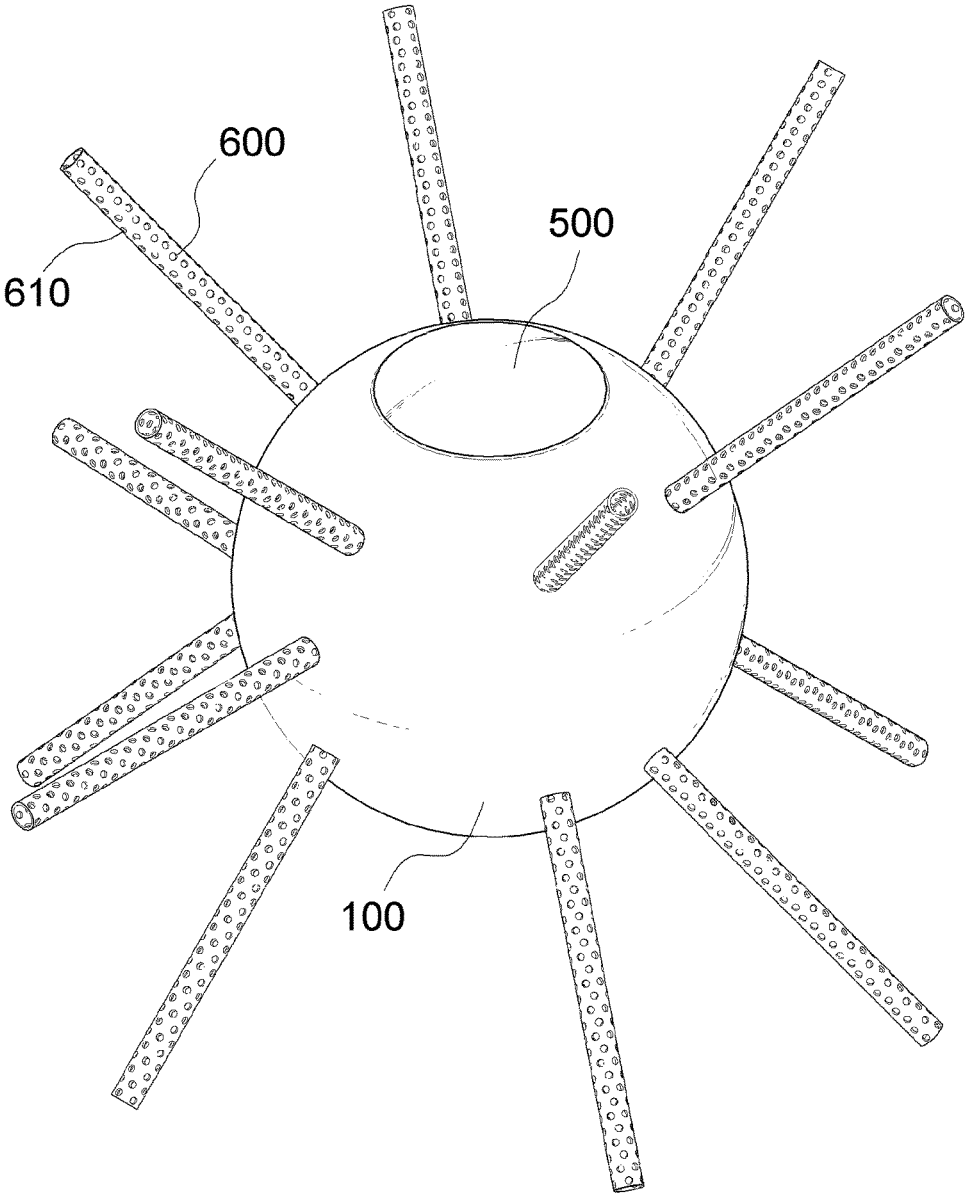
FIGS. 7 and 8 are, respectively, a perspective view and a cross-sectional view of a cooling device according to still another embodiment of the present invention.
Figure 8:
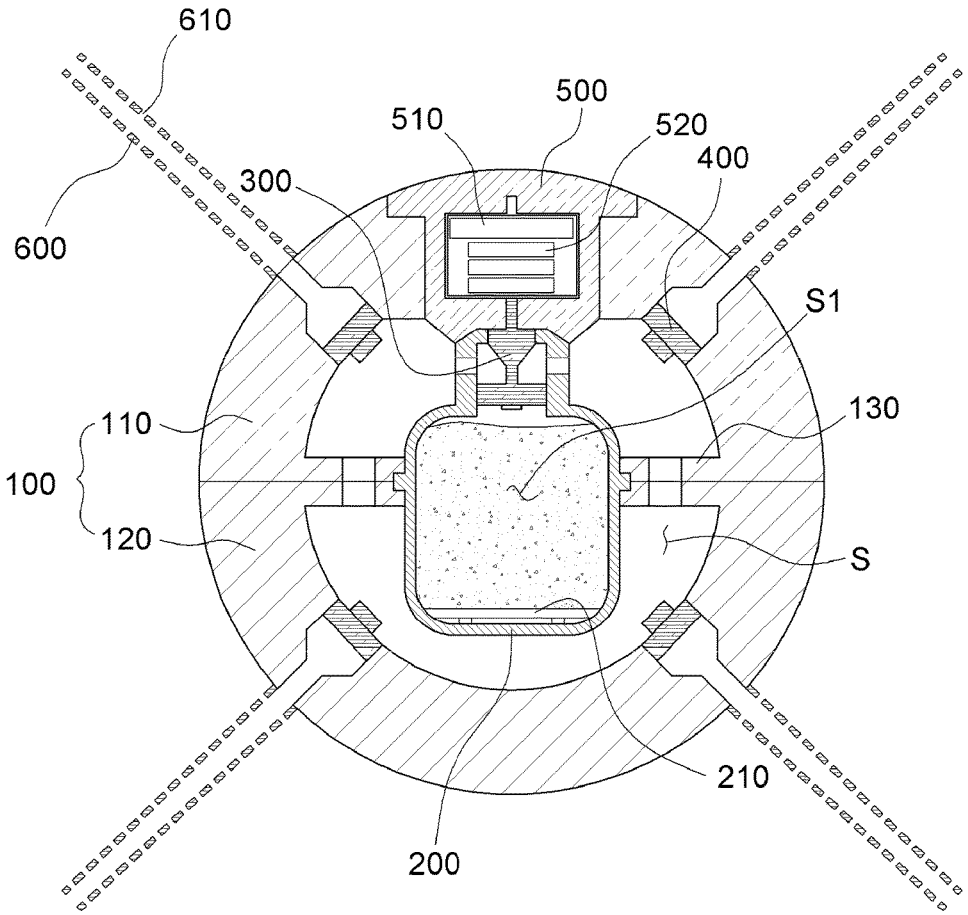

FIGS. 7 and 8 are, respectively, a perspective view and a cross-sectional view of a cooling device according to a third embodiment of the present invention. The detailed descriptions of the same or similar components will be referred to FIGS. 1, 2, and 4.

Referring to FIGS. 7 and 8, the cooling device may further include a guide pipe which is disposed on a discharge hole 102 and extends outwardly from the outer surface of an outer case 100 to guide a path of the coolant discharged from the discharge hole 102. A plurality of guide pipes 600 may be provided in the same number as the discharge holes 120, and may be spaced apart from each other at a predetermined interval, extending outwardly from the outer surface of the outer case 100. A plurality of ejection holes 610 may be formed on the sidewall of the guide pipe 600 so that the coolant can be sprayed over a wide range.

Figure 9:
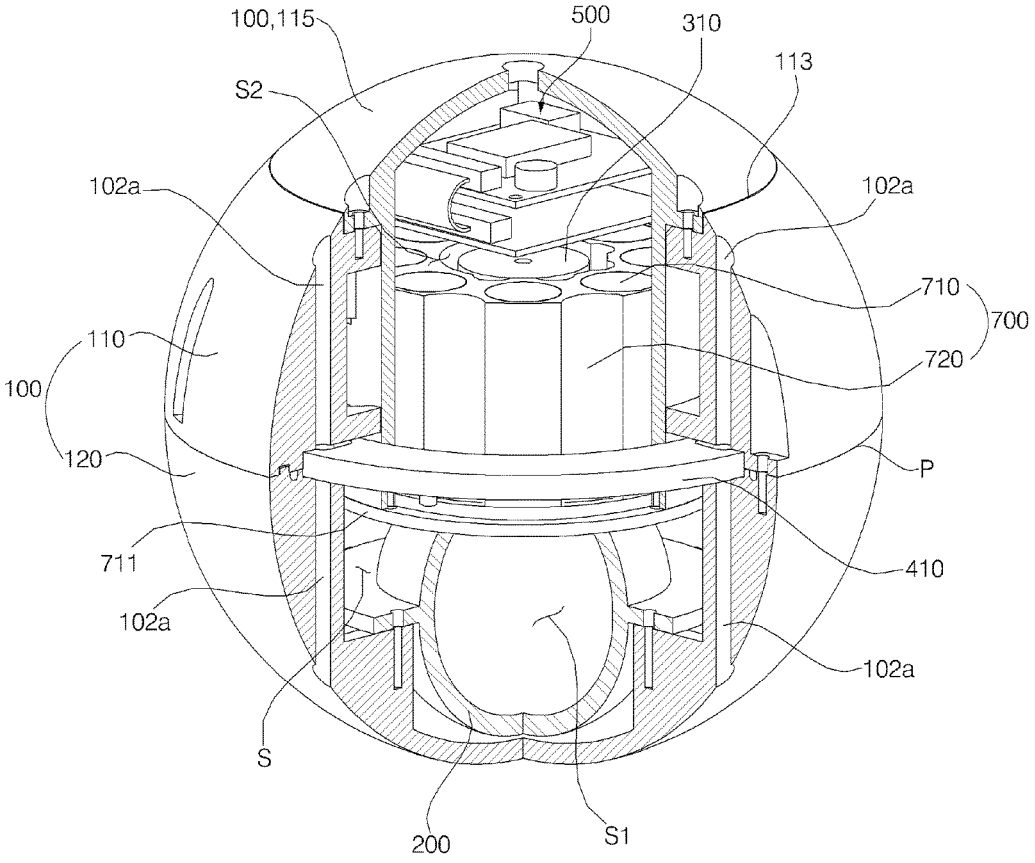
FIG. 9 is a partially cutaway perspective view of a cooling device according to a fourth embodiment.
Figure 10A:
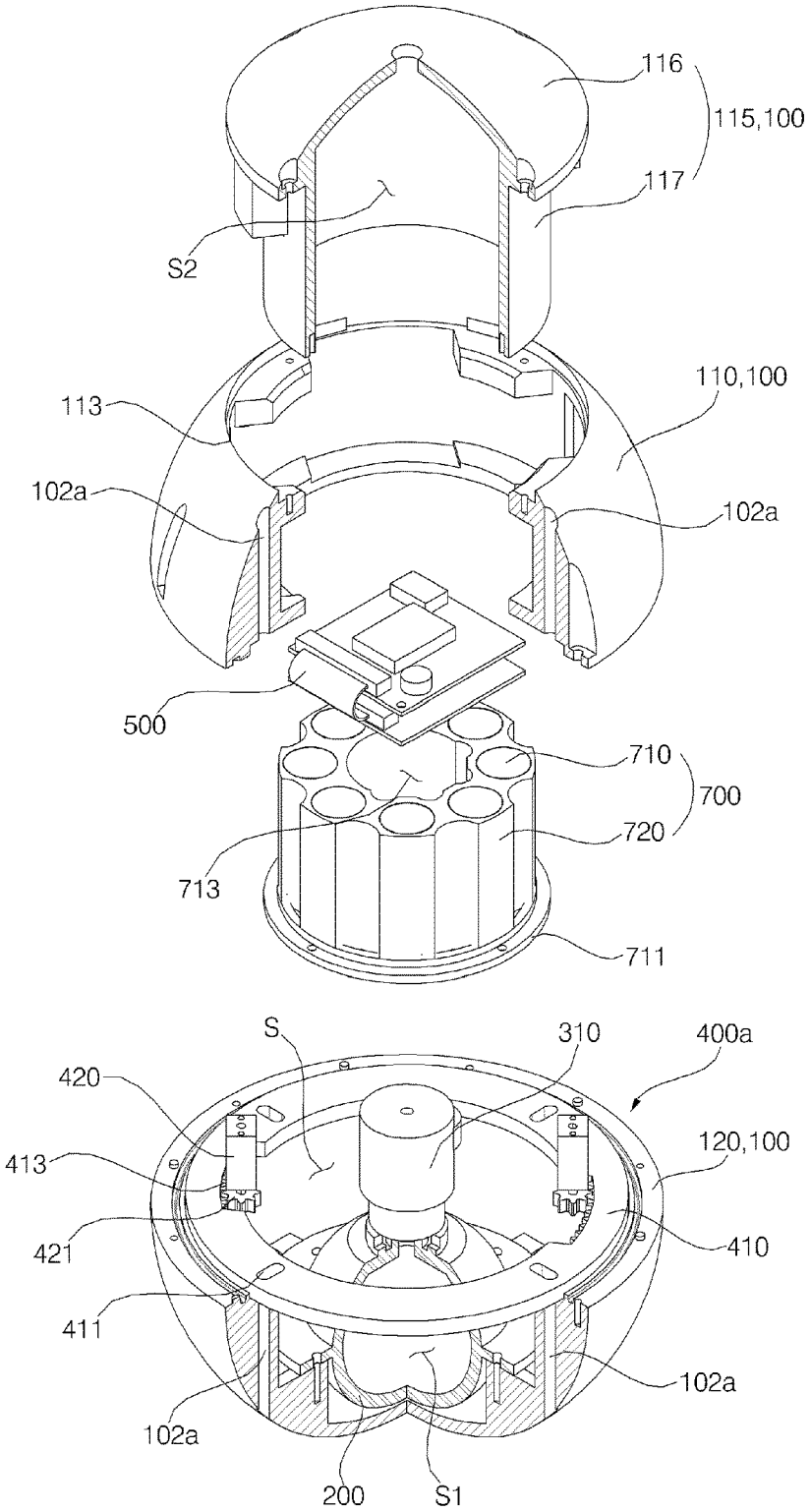
FIGS. 10A and 10B are exploded perspective views of FIG. 9.
Figure 10B:
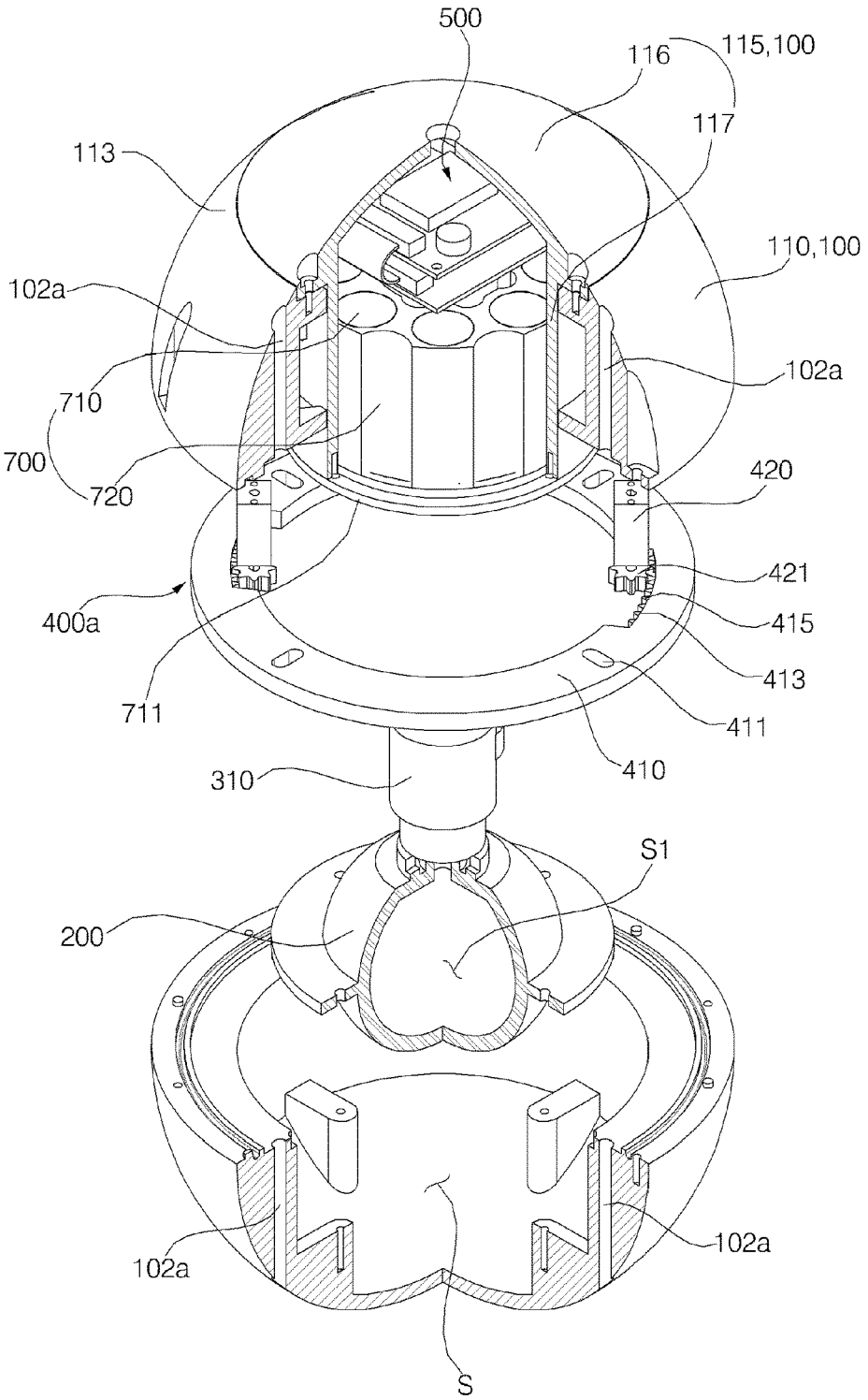
Figure 11:
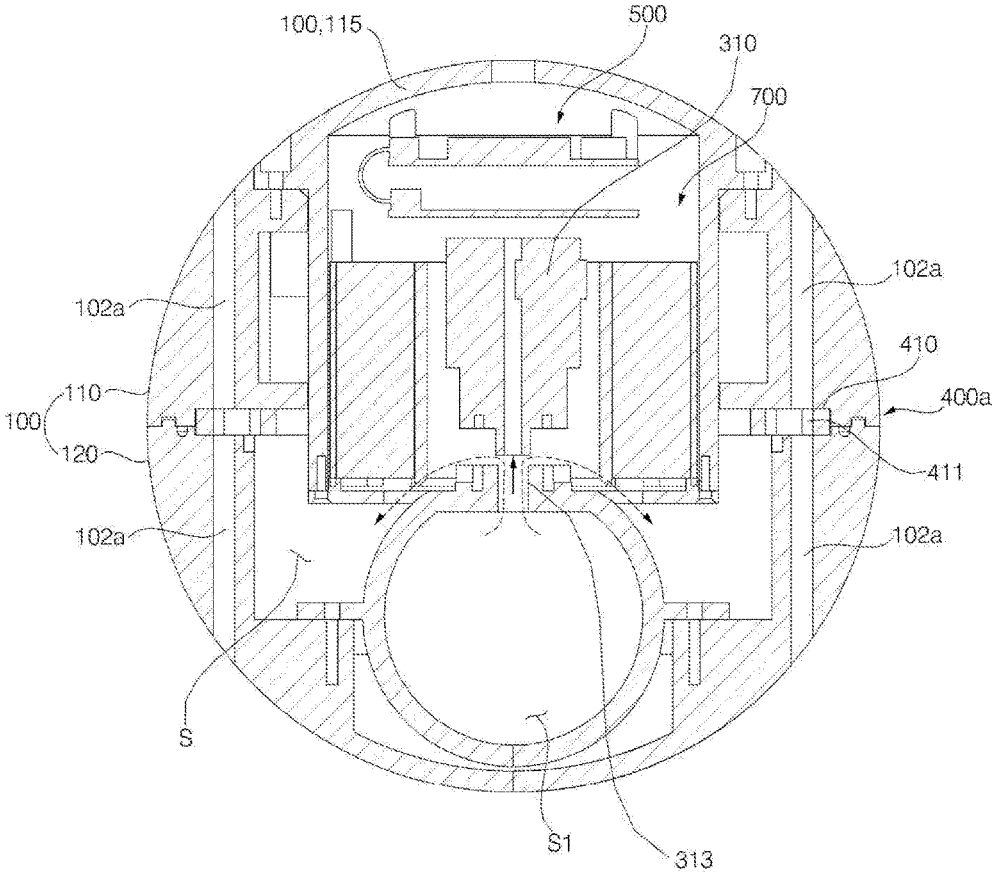
FIG. 11 is a cross-sectional view illustrating a process in which a coolant flows from a storage space to an accommodation space of FIG. 9.
Figure 12:
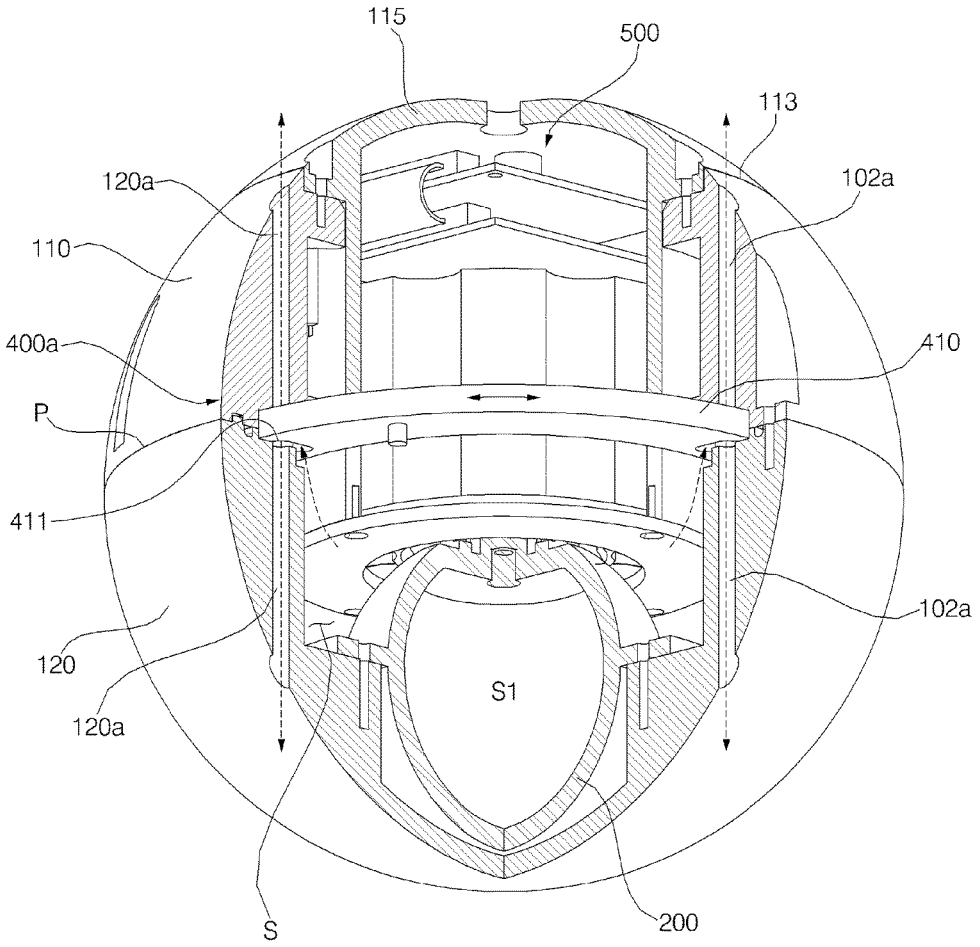
FIG. 12 is a partially cutaway perspective view illustrating a process of discharging the coolant from the accommodation space of FIG. 9 to the outside.

The cooling devices according to the present invention are disposed at a predetermined interval in coal stockpiles, and when the measured temperature reaches a set temperature, the accommodated liquefied nitrogen is ejected to the outside to lower the ambient temperature, thereby preventing spontaneous ignition of the coal. In addition, the cooling device can be used for existing coal stockpiles without additional expansion of equipment, and also can be re-used, so that it is possible to create economic effect. Further, since a collecting device can be installed relatively easily, it is possible to easily apply the cooling device to the conventional equipment FIG. 9 is a partially cutaway perspective view of a cooling device according to a fourth embodiment, FIGS. 10A and 10B are exploded perspective views of FIG. 9, FIG. 11 is a cross-sectional view illustrating a process in which a coolant flows from a storage space to an accommodation space, and FIG. 12 is a partially cutaway perspective view illustrating a process of discharging the coolant from the accommodation space of FIG. 9 to the outside. The detailed descriptions of the same or similar components will be referred to FIGS. 1, 2, and 4.

Referring to FIGS. 9 to 12, an outer case 100 includes an upper case 110, a lower case 120, and an electrical unit case 115 coupled to the upper case 110.

The upper case 110 and the lower case 120, which are coupled to each other, may have a hollow hemispherical shape.

The upper case 110 may have a circular opening 113 on the upper side. The opening 113 may be coupled to the electrical unit case 115.

The lower case 120 may have an upper side opened to form an accommodation space S together with the upper case 110.

The electrical unit case 115 may divide the accommodation space S formed by the upper case 110 and the lower case 120 to form a predetermined installation space S2 in which electrical components including the above-described control module 500 are installed. The electrical unit case 115 may include a shielding portion 116 which shields the opening 113 and constitutes a part of the outer surface of the spherical shape, and a partition 117 which extends from the inner surface of the shielding portion 116 toward the accommodation space S and has a hollow cylindrical shape.

The installation space S2 formed by the shielding portion 116 and the partition 117 is shielded from the accommodation space S. Electrical parts, such as the control module 500, a battery unit 700, and the like, may be disposed inside the installation space S2.

The battery unit 700 may include a battery case 720 and a shielding flange 711.

The battery case 720 may accommodate a battery 710 therein. A plurality of batteries 710 may be provided, and the plurality of batteries 710 may be annularly disposed in the battery case 720. Although the battery case 720 is described as accommodating the battery in the present embodiment, it is not essential. That is, although the term "battery" is used, the battery case 720 may not include a battery, and the structure of the battery case 720 itself may contribute to the present embodiment. In this case, the battery may be disposed at any place in the installation space S2.

The shielding flange 711 may be coupled to a lower end of the battery case 720. The shielding flange 711 may be coupled to the lower end of the partition 117 of the electrical unit case 115 to seal the installation space S2. The shielding flange 711 is formed to protrude outwards at the lower end of the battery case 720, and the partition 117 of the electrical unit case 115 is coupled to the battery case 721 while accommodating the battery unit 700, so that the installation space S2 can be sealed.

As described above, the cooling device in accordance with the fourth embodiment is formed such that the installation space S2 in which the electrical parts, such as the control module 500 and the battery unit 700, are installed is partitioned from the accommodation space S where the coolant is contained and the electrical parts are concentrated in the installation space S2, and thereby it is possible to simplify the layout design of wiring, valves, and the like.

The lower case 120 may include an inner case 200 disposed therein.

The inner case 200 may include a coolant discharge hole 313 through which the contained coolant is discharged upward. Preferably, the coolant discharge hole 313 may be formed on the upper side of the inner case 200 so as to be opened to the side where the battery unit 700 is disposed.

Unlike the first embodiment to the third embodiment described above, a supply valve 310 may be disposed so as to vertically pass through the battery unit 700 and may open and close the coolant discharge hole 313 while linearly moving so that the accommodation space S and the installation space S2 are mutually sealed. The supply valve 310 may be composed of a solenoid.

For the arrangement space of the supply valve 310, the battery case 720 may include a valve installation hole which is vertically opened at the center of the interior. The gap between the supply valve 310 and the valve installation hole 713 may be sealed so that the coolant in the accommodation space S does not leak into the installation space S2 even when the supply valve 310 moves.

Referring to FIG. 11, the supply valve 310 composed of a solenoid may vertically move along the valve installation hole 713. When the supply valve 310 linearly moves upward to open the coolant discharge hole 313, the coolant compressed and stored in the storage space S1 may be discharged to the accommodation space S through the coolant discharge hole 313.

Referring to FIG. 12, a plurality of discharge holes 102*a* may be formed, extending linearly along an upper case 110 and a lower case 120. In the first embodiment to the third embodiments of FIGS. 1 to 8, the discharge holes 102 are formed independently at a plurality of positions in the upper case 110 and the lower case 120, whereas the discharge hole 102*a* of the fourth embodiment of the present invention is formed in a straight line and is formed over the upper case 110 and the lower case 120.

An injection valve 400*a* of the fourth embodiment may be implemented in a different configuration from the injection valve 400 of the first to third embodiments.

Referring to FIG. 12, the injection valve 400*a* may include a valve rotary plate 410 rotatably disposed along a parting line P that separates the inner surface of the upper case 110 from the inner surface of the lower case 120.

The valve rotary plate 410 may be disposed to overlap with the discharge holes 102*s* extending vertically in the upper case 110 and the lower case 120. The valve rotary plate 410 may be formed with a ring-shaped plate having a hollow. An inner circumferential surface forming the hollow of the valve rotary plate 410 may be arranged to encircle the outer circumferential surface of a partition 117 of an electrical unit case 115. The edge of the valve rotary plate 410 may be inserted between the upper case 110 and the lower case 120 and disposed to overlap with the discharge hole 102*a*, as described above.

The injection valve 400*a* may further include a valve driving unit 420 which drives the valve rotary plate 410 to rotate.

As shown in FIGS. 10A and 10B, the valve driving unit 420 may include a driving motor 420 and a pinion gear 421 which is connected to a rotating shaft of the driving motor 420 and rotates. Here, the driving motor 420 may be provided as a stepping motor which is easy to control the rotation to one side or the other side.

The driving motor 420 may be fixed on the inner surface of the upper case 110 and have the rotating shaft vertically formed. The pinion gear 421 may rotate coaxially with the vertically formed rotating shaft of the driving motor 420.

The pinion gear 421 may be engaged with a rack gear 413 which is formed by being partially cut in the circumferential direction at the inner circumferential surface of the valve rotary plate 410.

The valve rotary plate 410 may include a plurality of connection holes 411 each of which simultaneously communicate with the discharge hole 102*a* and an accommodation space S. When the connection hole 411 is located at a position where it simultaneously communicates with the discharge hole 102*a* and the accommodation space S by the rotation of the valve rotary plate 410, it may be preferable that the connection hole 411 is connected to the accommodation space S while the upper side of the connection hole 411 corresponds to the upper side of the discharge hole 102*a* and a part of the lower side of the connection hole 411 corresponds to the lower side of the discharge hole 102*a*.

When a risk of ignition arises according to a risk model preset based on the ambient temperature of an outer case 100, a control module 500 drives the driving motor 420 to rotate the pinion gear 421 to one side or the other side, as illustrated in FIG. 12. The rotational force of the pinion gear 421 may be transmitted to the rack gear 413. The valve rotary plate 410 is rotated by the rack gear 413 so that the communication hole 411 and the discharge hole 102*a* can be matched. The accommodation space S and the discharge hole 102*a* are communicated with each other by matching the communication hole 411 and the discharge hole 102*a* so that the coolant in the accommodation space S is externally discharged to the coal stockpiles, thereby lowering the temperature of the coal stockpiles.

According to the embodiments of the present invention, the cooling devices are disposed in stored coal stockpiles at a predetermined interval, and each of the cooling device includes a temperature detection sensor for sensing the ambient temperature and when the temperature measured through the temperature sensor reaches a set temperature, the cooling device discharges contained liquefied nitrogen to the outside, thereby lowering the ambient temperature and advantageously preventing spontaneous ignition.

In addition, according to the embodiments of the present invention, the cooling device collects and store data regarding temperature changes and buried positions and transmits the data to a separate main control unit, so that a user can check information of stored coal in real time. Also, it is possible to predict spontaneous ignition, as well as to provide a high operational reliability by analyzing the collected data based on a hidden Markov model (HMM) machine learning algorithm.

Moreover, the cooling device according to the embodiments of the present invention can be used in existing coal stockpiles without additional expansion of equipment, and may be economically advantageous due to simple installation and maintenance.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

REFERENCE NUMERALS

| | |
|---|---|
| 100: OUTER CASE | 200: INNER CASE |
| 300: SUPPLY VALVE | 400: BACKFLOW PREVENTION VALVE |
| 500: CONTROL MODULE | 510: TEMPERATURE SENSOR |

-continued

| REFERENCE NUMERALS |
| --- |
| 520: OPENING/CLOSING CONTROLLER S: ACCOMMODATION SPACE<br>S1: STORAGE SPACE |

What is claimed is:

1. A cooling device for preventing spontaneous combustion of coal stockpiles, the cooling device comprising:

an outer case including:

an accommodation space formed therein, discharge holes formed therethrough, and an opening formed thereon;

at least one injection valve mounted inside the outer case and configured to close or open the discharge holes;

an inner case disposed in the accommodation space and having including:

a storage space in which a coolant is stored, and a coolant discharge hole formed through the inner case;

a supply valve provided inside the outer case and configured to open or close the coolant discharge hole to selectively supply the coolant stored in the storage space to the accommodation space; and a control module configured to measure an external temperature and to control the supply valve and the at least one injection valve, the control module including:

a module case fixed to the outer case and sealing the opening; and a valve controller provided in the module case and configured to open or close the supply valve and the at least one injection valve based on at least the external temperature such that the coolant is kept in the storage space or is discharged from the storage space to an outside of the outer case through the discharge holes via the coolant discharge hole and the accommodation space.

2. The cooling device of claim 1, wherein a pressure in the storage space in which the coolant is stored is higher than a pressure in the accommodation space.

3. The cooling device of claim 1, wherein the inner case further includes a bottom plate which is slid in a moving direction of the coolant along an inner surface of the storage space when the coolant in the storage space is moved to the accommodation space.

4. The cooling device of claim 1, wherein the outer case further includes:

an upper case having a lower side opened;

a lower case coupled to the upper case to form the accommodation space; and a fixing arm protruding from an inner surface of the upper case or the lower case and having one end coupled to an outer surface of the inner case to attach or detach the inner case.

5. The cooling device of claim 1, wherein:

each of the discharge holes includes a first hole adjacent to an outer surface of the outer case and a second hole extending from the first hole and adjacent to an inner surface of the outer case, and a diameter of the second hole is greater than a diameter of the first hole.

6. The cooling device of claim 1, wherein the outer case includes:

an upper case in a hollow hemispherical shape which has the opening formed in a circular shape on an upper side and is opened downward; and a lower case in a hollow hemispherical shape which is opened upward to form the accommodation space and is coupled to the upper case, and wherein the module case is mounted to seal the opening of the upper case and to partition a part of the accommodation space to form an installation space inside the module case.

7. The cooling device of claim 6, wherein the valve controller is disposed in the installation space so as to be shielded from the accommodation space.

8. The cooling device of claim 7, further comprising a battery unit disposed in the installation space, wherein:

the inner case includes the coolant discharge hole opened to a side where the battery unit is disposed, and the supply valve is disposed to vertically pass through the battery unit and opens and closes the coolant discharge hole while linearly moving so as to mutually seal the accommodation space and the installation space.

9. The cooling device of claim 8, wherein the battery unit includes a shielding flange at a lower end thereof which is hermitically coupled to a lower end of the module case and a battery case which has a valve installation hole at the center thereof for installing the supply valve and is coupled to the shielding flange.

10. The cooling device of claim 6, wherein:

each of the discharge holes is disposed to extend in a straight line along the upper case and the lower case, and the injection valve is installed to rotate between the upper case and the lower case to open and close the discharge hole.

11. The cooling device of claim 10, wherein:

the injection valve includes a valve rotary plate which is rotatably disposed along a parting line that separates an inner surface of the upper case from an inner surface of the lower case and which is disposed to overlap with the discharge holes, and the valve rotary plate includes communication holes each simultaneously communicating with the accommodation space and each of the discharge holes.

12. The cooling device of claim 1, further comprising at least one guide pipe extending outward from an outer surface of the outer case and configured to guide a moving path of the coolant discharged from the discharge holes.

13. The cooling device of claim 12, wherein the at least one guide pipe has a plurality of ejection holes on a sidewall thereof to eject the coolant.

* * * * *